US008257056B2

(12) United States Patent
Peters

(10) Patent No.: US 8,257,056 B2
(45) Date of Patent: Sep. 4, 2012

(54) SERVICE PACK VARIABLE DISPLACEMENT PUMP

(75) Inventor: Mark E. Peters, New London, WI (US)

(73) Assignee: Illinois Took Works Inc., Glenview, IL (US)

( * ) Notice: Subject to any disclaimer, the term of this patent is extended or adjusted under 35 U.S.C. 154(b) by 790 days.

(21) Appl. No.: 12/358,119

(22) Filed: Jan. 22, 2009

(65) Prior Publication Data

US 2009/0196767 A1 Aug. 6, 2009

Related U.S. Application Data

(60) Provisional application No. 61/026,124, filed on Feb. 4, 2008.

(51) Int. Cl.
*F04B 49/00* (2006.01)

(52) U.S. Cl. ..... 417/212

(58) Field of Classification Search ..... 417/212, 417/346

See application file for complete search history.

(56) References Cited

U.S. PATENT DOCUMENTS

| | | | |
|---|---|---|---|
| 3,156,313 | A | 11/1964 | Peterson |
| 3,319,739 | A | 5/1967 | Mores |
| 3,587,237 | A | 6/1971 | Pierrat |
| 3,891,354 | A | 6/1975 | Bosch |
| 4,029,439 | A | 6/1977 | Adams |
| 4,293,284 | A | 10/1981 | Carlson et al. |
| 4,359,137 | A | 11/1982 | Merz et al. |
| 5,421,705 | A | 6/1995 | Benckert |
| 5,564,522 | A | 10/1996 | Markin et al. |
| 6,478,714 | B2 | 11/2002 | Onnen et al. |
| 6,568,493 | B2 | 5/2003 | Parkert et al. |
| 2005/0133489 | A1 | 6/2005 | Gitter et al. |
| 2006/0027547 | A1 | 2/2006 | Silvestro |
| 2008/0122195 | A1 | 5/2008 | Beeson et al. |
| 2008/0264920 | A1 | 10/2008 | Leisner et al. |
| 2008/0264921 | A1 | 10/2008 | Kropp et al. |
| 2008/0264922 | A1 | 10/2008 | Fosbinder |

FOREIGN PATENT DOCUMENTS

| | | |
|---|---|---|
| AU | 468888 | 12/1975 |
| AU | 4447185 | 1/1987 |
| DE | 202005000677 | 3/2005 |
| DE | 102004017087 | 11/2005 |
| EP | 0458050 | 11/1991 |
| EP | 0580248 | 1/1994 |
| EP | 1065386 | 1/2001 |
| EP | 1522693 | 4/2005 |
| FR | 2873364 | 1/2006 |

(Continued)

OTHER PUBLICATIONS

U.S. Appl. No. 11/943,564, filed Nov. 20, 2007; Beeson et al.

(Continued)

*Primary Examiner* — Anh Mai
*Assistant Examiner* — Elmito Breval
(74) *Attorney, Agent, or Firm* — Fletcher Yoder P.C.

(57) ABSTRACT

A service pack, in certain embodiments, includes an engine, a variable displacement pump coupled to the engine, and a controller configured to control displacement of the variable displacement pump in response to a load condition associated with the engine. A method of managing power of an engine-driven system, in certain embodiments, includes sensing a load associated with an engine coupled to a variable displacement pump. The method also includes adjusting pump displacement of the variable displacement pump in response to the sensed load and one or more limits associated with the engine.

20 Claims, 5 Drawing Sheets

FOREIGN PATENT DOCUMENTS

| | | |
|---|---|---|
| GB | 959381 | 6/1964 |
| GB | 1290925 | 9/1972 |
| GB | FR2232692 | 1/1975 |
| JP | 61271118 | 12/1986 |
| JP | 06227309 | 8/1994 |
| WO | WO0112967 | 2/2001 |
| WO | WO2007067178 | 6/2007 |
| WO | WO2008067252 | 6/2008 |

OTHER PUBLICATIONS

U.S. Appl. No. 12/040,568, filed Feb. 29, 2008; Beeson.

U.S. Appl. No. 12/358,147, filed Jan. 22, 2009; Peters.

U.S. Appl. No. 12/361,394, filed Jan. 28, 2009; Peotter et al.

Brochure entitled "HIPPO 2032E"; Mobile Hydraulic Equipment Co, LLC; www.multipower.us; 2 pages.

U.S. Appl. No. 12/040,328, filed Feb. 29, 2008, Beeson.

SERVICE PACK VARIABLE DISPLACEMENT PUMP

CROSS REFERENCE TO RELATED APPLICATION

This application claims priority to U.S. Provisional Patent Application No. 61/026,124, entitled "Service Pack Pressure Compensated Pump", filed on Feb. 4, 2008, which is herein incorporated by reference in its entirety.

BACKGROUND

The invention relates generally to hydraulic systems. More particularly, this invention relates to the delivery and control of fluid power to a service truck to operate equipment on or near the truck, for example, but not limited to, a crane with multiple functions.

Existing work vehicles often integrate auxiliary resources, such as electrical power, compressor air service, and/or hydraulic service, directly from the mechanical power of the main vehicle engine. Specifically, the main vehicle engine may drive a power take-off (PTO) shaft, which in turn drives the various integrated auxiliary resources. This is common in many applications where the auxiliary systems are provided as original equipment, either standard with the vehicle or as an option. The work vehicles also may include a clutch or other selective engagement mechanism to enable the selective engagement and disengagement of the integrated auxiliary resources.

Unfortunately, these integrated auxiliary resources rely on operation of the main vehicle engine. The main vehicle engine is typically a large engine, which is particularly noisy, significantly over powered for the integrated auxiliary resources, and fuel inefficient. For example, the main vehicle engine may be a spark ignition engine or a compression ignition engine (e.g., diesel engine) having six or more cylinders. The main vehicle engine may have over 200 horsepower, while the integrated auxiliary resources may only need about 20-40 horsepower. Unfortunately, an operator typically leaves the main vehicle engine idling for extended periods between actual use of the integrated auxiliary resources, simply to maintain the option of using the resources without troubling the operator to start and stop the main vehicle engine. Such operation reduces the overall life of the engine and drive train for vehicle transport needs.

Furthermore, the vehicle with integrated auxiliary resources does not control the power consumption, because the main vehicle engine has equal or more power than what is needed under all maximum power consumption circumstances (e.g., full hydraulic flow and pressure). Instead, the main vehicle engine typically runs at a normal condition without any change despite the various loads associated with the integrated auxiliary resources. At this normal condition, the main vehicle engine generally provides a great deal of wasted power.

BRIEF DESCRIPTION

Certain aspects commensurate in scope with the originally claimed invention are set forth below. It should be understood that these aspects are presented merely to provide the reader with a brief summary of certain forms the invention might take and that these aspects are not intended to limit the scope of the invention. Indeed, the invention may encompass a variety of aspects that may not be set forth below.

A service pack, in certain embodiments, includes an engine, a variable displacement pump coupled to the engine, and a controller configured to control displacement of the variable displacement pump in response to a load condition associated with the engine. A method of managing power of an engine-driven system, in certain embodiments, includes sensing a load associated with an engine coupled to a variable displacement pump. The method also includes adjusting pump displacement of the variable displacement pump in response to the sensed load and one or more limits associated with the engine.

DRAWINGS

These and other features, aspects, and advantages of the present invention will become better understood when the following detailed description is read with reference to the accompanying drawings in which like characters represent like parts throughout the drawings, wherein.

DETAILED DESCRIPTION

Figure 1:
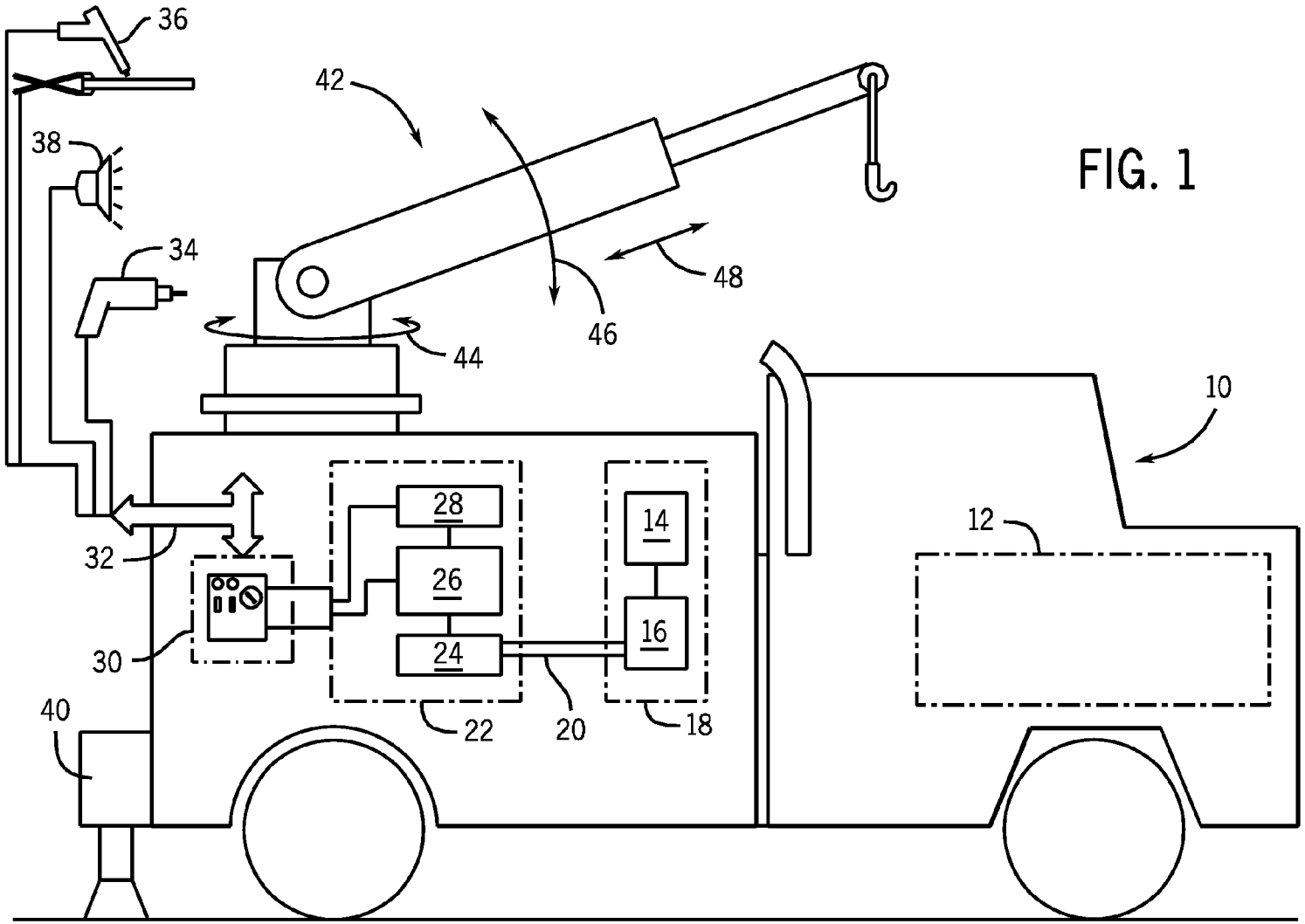
FIG. 1 is a diagram illustrating a work vehicle having first and second service pack modules with load sense in accordance with embodiments of the present technique.

One or more specific embodiments of the present invention will be described below. In an effort to provide a concise description of these embodiments, all features of an actual implementation may not be described in the specification. It should be appreciated that in the development of any such actual implementation, as in any engineering or design project, numerous implementation-specific decisions must be made to achieve the developers' specific goals, such as compliance with system-related and business-related constraints, which may vary from one implementation to another. Moreover, it should be appreciated that such a development effort might be complex and time consuming, but would nevertheless be a routine undertaking of design, fabrication, and manufacture for those of ordinary skill having the benefit of this disclosure.

As discussed below, certain embodiments may include control of a pump based on various loads associated with the engine driving the pump. In the present embodiments, the engine may include a spark ignition (SI) engine or a compression ignition (CI) engine other than the main vehicle engine. Thus, the engine may be substantially smaller in size, weight, and power output (e.g., horsepower) as compared to the main vehicle engine. For example, certain embodiments of the engine may provide 20-40 horsepower. Advantageously, the smaller engine provides greater fuel efficiency and costs less for various applications in addition to the clear advantages in reduced size, weight, and so forth.

Unfortunately, the smaller engine can become overloaded by one or more loads during operation. In certain embodiments, the engine may drive an electrical generator, a compressor, a hydraulic pump, or a combination thereof. Thus, the loads may include various electrical tools, lights, a welding torch, a cutting torch, and the like. The loads also may include an air tool, a pneumatic spray gun, and the like. Furthermore, the loads may include a hydraulic lift, a hydraulic crane, a hydraulic stabilizer, a hydraulic tool, and the like. Each of these loads has certain demands, which can overload the prime mover either alone or in certain combinations with one another.

As discussed below, the present embodiments provide a control scheme to tailor or generally match the loads (e.g., hydraulic loads) on the engine to the available power of the engine. Although the disclosed embodiments refer to hydraulic loads, the techniques may be used with other loads such as electrical generators, air compressors, and so forth. Specifically, as discussed below, the disclosed control scheme limits the load created by a hydraulic pump in response to various sensor feedback, such as direct engine load feedback, hydraulic pressure feedback, engine RPMs, and so forth. The disclosed embodiments may be utilized with a variety of portable service packs, work vehicles with service packs or features, or other suitable applications. For example, the disclosed embodiments may be used in combination with any and all of the embodiments set forth in U.S. application Ser. No. 11/742,399, filed on Apr. 30, 2007, and entitled "ENGINE-DRIVEN AIR COMPRESSOR/GENERATOR LOAD PRIORITY CONTROL SYSTEM AND METHOD," which is hereby incorporated by reference in its entirety. Furthermore, the disclosed embodiments may be used in combination with any and all of the embodiments set forth in U.S. application Ser. No. 11/943,564, filed on Nov. 20, 2007, and entitled "AUXILIARY SERVICE PACK FOR A WORK VEHICLE," which is hereby incorporated by reference in its entirety.

Embodiments of the control scheme essentially tailor or match the loads on the engine with the power capability of the engine, thereby maximizing use of the engine for more efficient operation. Regarding hydraulic power, the disclosed embodiments are able to satisfy the needs of the operator by providing full pressure at less than full flow, and by providing full flow at less than full pressure (e.g., "power matching"). In order to provide this "power matching" feature, the control scheme functions to control the power consumption of the hydraulic system so as not to overpower the smaller engine.

Turning now to the drawings, FIG. 1 illustrates a work vehicle 10 including a main vehicle engine 12, first and second service pack modules 18 and 22, and various equipment in accordance with certain embodiments of the present technique. As discussed in further detail below, the first and second service pack modules 18 and 22 may provide various resources, such as electrical power, compressed air, and hydraulic power, with or without assistance from the main vehicle engine 12. Thus, in some embodiments, the operator can shut off the main vehicle engine to reduce noise, conserve fuel, and increase the life of the main vehicle engine 12, while the service pack modules 18 and 22 are self-powered or power one another. However, in some embodiments, the service pack modules 18 and 22 may utilize and/or provide some resources of the vehicle 10, e.g., use fuel from the vehicle, use hydraulic power from the vehicle, provide hydraulic power to the vehicle, and so forth. The illustrated work vehicle 10 is a work truck, yet other embodiments of the vehicle may include other types and configurations of vehicles.

The main vehicle engine 12 may include a spark ignition engine (e.g., gasoline fueled internal combustion engine) or a compression ignition engine (e.g., a diesel fueled engine), for example, an engine with 6, 8, 10, or 12 cylinders with over 200 horsepower. The vehicle engine 12 includes a number of support systems. For example, the vehicle engine 12 consumes fuel from a fuel reservoir, typically one or more liquid fuel tanks, which will be addressed later. Further, the vehicle engine 12 may include or couple to an engine cooling system, which may include a radiator, circulation pump, thermostat controlled valve, and a fan. The vehicle engine 12 also includes an electrical system, which may include an alternator or generator along with one or more system batteries, cable assemblies routing power to a fuse box or other distribution system, and so forth. The vehicle engine 12 also includes an oil lubrication system. Further, the vehicle engine 12 also couples to an exhaust system, which may include catalytic converters, mufflers, and associated conduits. Finally, the vehicle engine 12 may feature an air intake system, which may include filters, flow measurement devices, and associated conduits.

The service pack modules 18 and 22 may have a variety of resources, such as electrical power, compressed air, hydraulic power, and so forth. These service pack modules 18 and 22 also may operate alone or in combination with one another, e.g., dependent on one another. In the illustrated embodiment, the first service pack module 18 includes a service pack engine 14 and a variable displacement pump 16 with load sense as discussed in detail below. In particular, the variable displacement pump 16 may include a hydraulic pump, a water pump, a waste pump, a chemical pump, or any other fluid pump. The service pack engine 14 may include a spark ignition engine (e.g., gasoline fueled internal combustion engine) or a compression ignition engine (e.g., a diesel fueled engine), for example, an engine with 1-4 cylinders with approximately 10-80 horsepower. In some embodiments, the service pack engine 14 may have a small engine with approximately 10, 20, 30, 40, or 50 horsepower. Moreover, the service pack engine 14 may be undersized to improve fuel consumption, while the variable displacement pump 16 with load sense can satisfy the needs of the operator by providing full pressure at less than full flow or by providing full flow at less than full pressure (e.g., "power matching"). The variable displacement pump 16 may be configured to provide hydraulic power (e.g., pressurized hydraulic fluid) to one or more devices in the vehicle or elsewhere.

As illustrated in the embodiment of FIG. 1, the first and second service pack modules 18 and 22 are separate from one another and from vehicle engine 12. In other words, the first and second service pack modules 18 and 22 are stand-alone units relative to the vehicle engine 12, such that they do not rely on power from the vehicle engine 12. In some embodiments, the first and second service pack modules 18 and 22 may be combined as a single standalone unit, while still being separate from the vehicle engine 12. However, in the illustrated embodiment, the second service pack module 22 is driven by hydraulic fluid from the first service pack module 18, thereby making the second service pack module 22 dependent on the first service pack module 18 or another source of fluid (e.g., hydraulic fluid). Specifically, as illustrated in FIG. 1, the service pack engine 14 drives the variable displacement pump 16, which in turn drives fluid motor 24 (e.g., hydraulic motor) located in second service pack module 22.

The fluid motor 24 (e.g., hydraulic motor) contained in second service pack module 22 may be coupled to air compressor 26 as well as generator 28. The air compressor 26 and the generator 28 may be driven directly, or may be belt, gear, or chain driven, by the fluid motor 24. The generator 28 may include a three-phase brushless type, capable of producing power for a wide range of applications. However, other generators may be employed, including single phase generators and generators capable of producing multiple power outputs. The air compressor 26 may also be of any suitable type, although a rotary screw air compressor is presently contemplated due to its superior output to size ratio. Other suitable air compressors might include reciprocating compressors, typically based upon one or more reciprocating pistons.

The first and/or second service pack modules 18 and 22 include conduits, wiring, tubing, and so forth for conveying the services/resources (e.g., electrical power, compressed air, and fluid/hydraulic power) generated by these modules to an access panel 30. The access panel 30 may be located on any portion of the vehicle 10, or on multiple locations in the vehicle, and may be covered by doors or other protective structures. In one embodiment, all of the services may be routed to a single/common access panel 30. The access panel 30 may include various control inputs, indicators, displays, electrical outputs, pneumatic outputs, and so forth. In an embodiment, a user input may include a knob or button configured for a mode of operation, an output level or type, etc. In the illustrated embodiment, the first and second service pack modules 18 and 22 supply electrical power, compressed air, and fluid power (e.g., hydraulic power) to a range of applications designated generally by arrows 32.

As depicted, air tool 34, torch 36, and light 38 are applications connected to the access panel 30 and, thus, the resources/services provided by the service pack modules 18 and 22. The various tools may connect with the access panel 30 via electrical cables, gas (e.g., air) conduits, fluid (e.g., hydraulic) lines, and so forth. The air tool 34 may include a pneumatically driven wrench, drill, spray gun, or other types of air-based tools, which receive compressed air from the access panel 30 and compressor 26 via a supply conduit (e.g., a flexible rubber hose). The torch 36 may utilize electrical power and compressed gas (e.g., air or inert shielding gas) depending on the particular type and configuration of the torch 36. For example, the torch 36 may include a welding torch, a cutting torch, a ground cable, and so forth. More specifically, the welding torch 36 may include a TIG (tungsten inert gas) torch or a MIG (metal inert gas) gun. The cutting torch 36 may include a plasma cutting torch and/or an induction heating circuit. Moreover, a welding wire feeder may receive electrical power from the access panel 30. Moreover, a hydraulically powered vehicle stabilizer 40 may be powered by the fluid system, e.g., variable displacement pump 16, to stabilize the work vehicle 10 at a work site. In the illustration, a hydraulically powered crane 42 is also coupled to and powered by the variable displacement pump 16. Again, the service pack modules 18 and 22 provide the desired resources/services to run various tools and equipment without requiring operation of the main vehicle engine 12.

As noted above, the disclosed service pack modules 18 and 22 may be designed to interface with any desired type of vehicle. Such vehicles may include cranes, manlifts, and so forth, which can be powered by the service pack modules 18 and/or 22. In the embodiment of FIG. 1, the crane 42 may be mounted within a bed of the vehicle 10, on a work platform of the vehicle 10, or on an upper support structure of the vehicle 10 as shown in FIG. 1. Moreover, such cranes may be mechanical, electrical or hydraulically powered. In the illustrated embodiment, the crane 42 can be powered by the service pack modules 18 and/or 22 without relying on the vehicle engine 12. That is, once the vehicle is positioned at the work site, the vehicle engine 12 may be stopped and the service pack engine 14 may be started for crane operation and use of auxiliary services. In the embodiment illustrated in FIG. 1, the crane 42 is mounted on a rotating support structure, and hydraulically powered such that it may be rotated, raised and lowered, and extended (as indicated by arrows 44, 46 and 48, respectively) by pressurized hydraulic fluid provided by the service pack output 32.

The vehicle 10 and/or the service pack modules 18 and 22 may include a variety of protective circuits for the electrical power, e.g., fuses, circuit breakers, and so forth, as well as valving for the fluid (e.g., hydraulic) and air service. For the supply of electrical power, certain types of power may be conditioned (e.g., smoothed, filtered, etc.), and 12 volt power output may be provided by rectification, filtering and regulating of AC output. Valving for fluid (e.g., hydraulic) power output may include by way example, pressure relief valves, check valves, shut-off valves, as well as directional control valving. Moreover, the variable displacement pump 16 may draw fluid from and return fluid to a fluid reservoir, which may include an appropriate vent for the exchange of air during use with the interior volume of the reservoir, as well as a strainer or filter for the fluid. Similarly, the air compressor 26 may draw air from the environment through an air filter.

The first and second service pack modules 18 and 22 may be physically positioned at any suitable location in the vehicle 10. In a presently contemplated embodiment, for example, the service pack modules 18 and 22 may be mounted on, beneath or beside the vehicle bed or work platform rear of the vehicle cab. In many such vehicles, for example, the vehicle chassis may provide convenient mechanical support for the engine and certain of the other components of the service pack modules 18 and 22. For example, steel tubing, rails or other support structures extending between front and rear axles of the vehicle may serve as a support for the service pack modules 18 and 22 and, specifically, the components self-contained in those modules. Depending upon the system components selected and the placement of the service pack modules 18 and 22, reservoirs may be provided for storing fluid (e.g., hydraulic fluid) and pressurized air as noted above. However, the fluid reservoir may be placed at various locations or even integrated into the service pack modules 18 and/or 22. Likewise, depending upon the air compressor selected, no reservoir may be used for compressed air. Specifically, if the air compressor 26 includes a non-reciprocating or rotary type compressor, then the system may be tankless with regard to the compressed air.

In use, the service pack modules 18 and 22 provide various resources/services (e.g., electrical power, compressed air, fluid/hydraulic power, etc.) for the on-site applications completely independent of vehicle engine 12. For example, the service pack engine 14 generally may not be powered during transit of the vehicle from one service location to another, or from a service garage or facility to a service site. Once located at the service site, the vehicle 10 may be parked at a convenient location, and the main vehicle engine 12 may be shut down. The service pack engine 14 may then be powered to provide auxiliary service from one or more of the service systems described above. Where desired, clutches, gears, or other mechanical engagement devices may be provided for engagement and disengagement of one or more of the generator 28, the variable displacement pump 16, and the air compressor 26, depending upon which of these service are desired. Moreover, as in conventional vehicles, where stabilization of the vehicle or any of the systems is require, the vehicle may include outriggers, stabilizers, and so forth which may be deployed after parking the vehicle and prior to operation of the service pack modules. The disclosed embodiments thus allow for a service to be provided in several different manners and by several different systems without the need to operate the main vehicle engine 12 at a service site.

Figure 2:
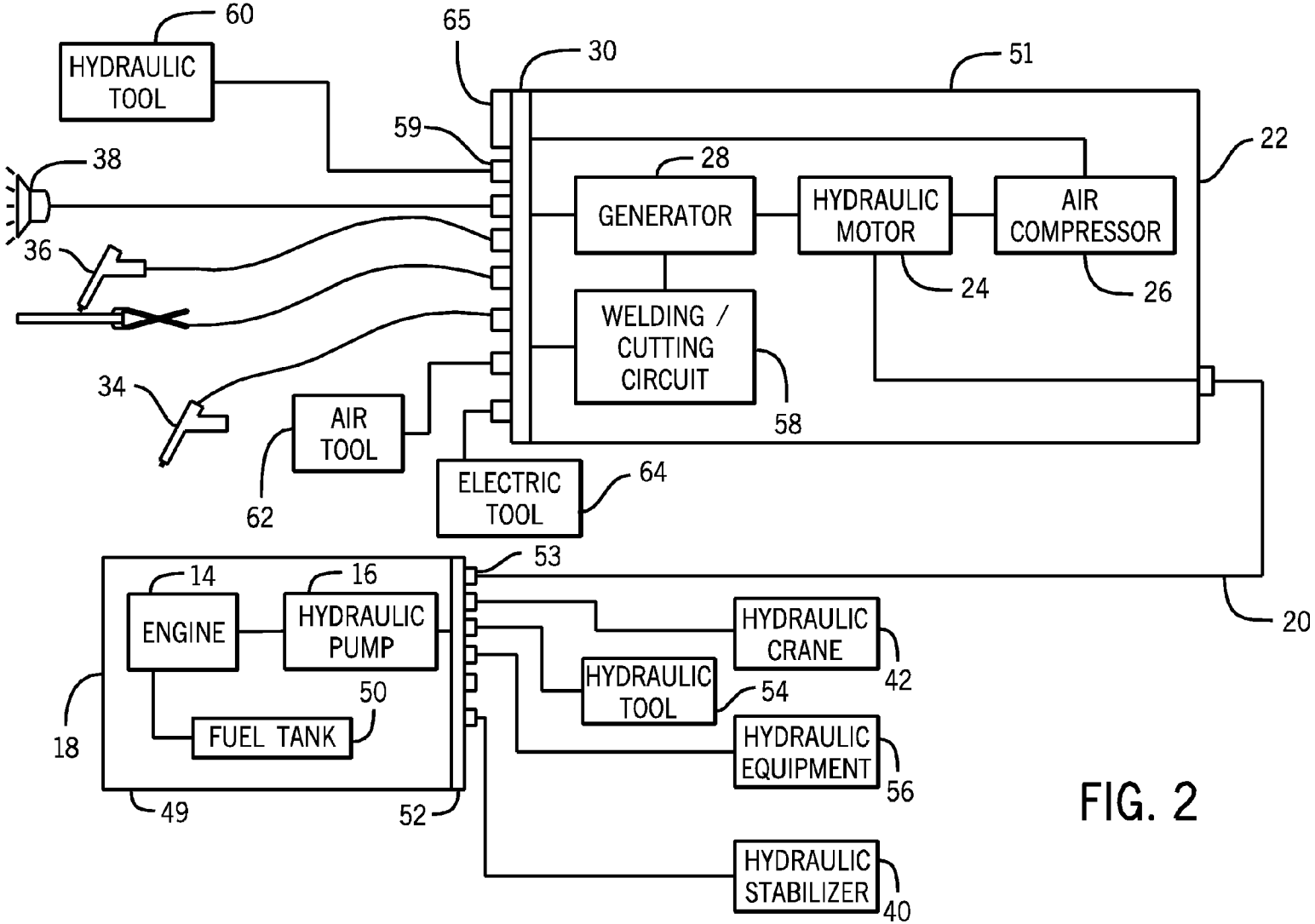
FIG. 2 is diagram illustrating first and second service pack modules in hydraulic communication with one another in accordance with embodiments of the present technique.

Several different arrangements are envisaged for the components of the first service pack module 18 and the second service pack module 22. FIG. 2 illustrates an embodiment of the first and second service pack modules 18 and 22, wherein the first service pack module 18 includes the service pack engine 14, the variable displacement pump 16, and a fuel tank 50, and wherein the second service pack module 22 includes the fluid motor 24 (e.g., hydraulic motor), the air compressor 26, and the generator 28. As discussed below, the components of each service pack modules 18 and 22 are self-contained in respective enclosures 49 and 51, such that the modules 18 and 22 are independent and distinct from one another. In other words, the enclosure 49 of the module 18 self contains the engine 14, the pump 16, and the fuel tank 50 independent of both the module 22 and various components of the vehicle 10. Similarly, the enclosure 51 of the module 22 self contains the hydraulic motor 24, the air compressor 26, and the generator 28 independent of both the module 18 and various components of the vehicle 10. Again, in alternate embodiments, a single unit may include the components of both service pack modules 18 and 22.

The service pack modules 18 and 22 may be used independently or in combination with one another. For example, the first service pack module 18 may be used to provide fluid (e.g., hydraulic) power for any type of fluid driven (e.g., hydraulically driven) system, which may or may not include the second service pack module 22. In certain embodiments, the first service pack module 18 may be described as dependent only on a source of fuel, such as gasoline or diesel fuel, to operate the engine 14 and provide the hydraulic power. By further example, the second service pack module 22 may be hydraulically driven by any suitable source of hydraulic power, which may or may not include the hydraulic pump 16 of the first service pack module 18. Thus, in certain embodiments, the second service pack module 22 may be described as hydraulically dependent on some source of hydraulic power, or more specifically, only hydraulic power dependence. However, some embodiments may combine the components of these two service pack modules 18 and 22 into a single unit.

Turning now to the details of FIG. 2, the first service pack module 18 includes a first service access panel 52, which includes fluid couplings 53 to output fluid (e.g., hydraulic fluid) from the variable displacement pump 16 to various external devices. In the illustrated embodiment, the fluid couplings 53 couple to the second service pack module 22, the hydraulic crane 42, a hydraulic tool 54, hydraulic equipment 56, and the hydraulic stabilizer 40. For example, the second service pack module 22 is connected to the first service pack module 18 via fluid tubing 20 (e.g., hydraulic tubing) connected to one of the couplings 53.

As further illustrated in FIG. 2, the second service pack module 22 includes the fluid motor 24 (e.g., hydraulic motor) coupled to the air compressor 26 and generator 28, which is connected to the welding/cutting circuit 58. The circuit 58 may include one or more circuits configured to provide power, functions, and control for welding, cutting, wire feeding, gas supply, and so forth. The generator 28 may provide electrical power to the welding circuit 58 to operate various welding devices, such as those discussed above. The second service pack module 22 also includes a service pack access panel (e.g., 30), which includes couplings 59 (e.g., electrical, air, and optionally hydraulic connectors) for various external devices. For example, the service pack module 22 may or may not provide fluid couplings 59 (e.g., hydraulic couplings) as a pass through from the fluid received into the system. Connections to access panel 30 may provide service to several tools, including hydraulic tool 60, air tool 62, electric tool 64, air tool (e.g., wrench) 34, torch 36, and light 38. In addition, the various external devices include electrical cables, air hoses, fluid tubing, and so forth, as illustrated by the lines extending between the devices and their respective couplings 59 on the panel 30. The access panel 30 also may include one or more controls 65 for the various services/resources, e.g., electrical power, compressed air, hydraulics, etc. As discussed below, these controls 65 may include input controls (e.g., switches, selectors, keypads, etc.) and output displays, gauges, and the like.

As appreciated, the generator 28 and/or circuit 58 may be configured to provide AC power, DC power, or both, for various applications. Moreover, the circuit 58 may function to provide constant current or constant voltage regulated power suitable for a welding or cutting application. Thus, the torch 36 may be a welding torch 36, such as a MIG welding torch, a TIG welding torch, and so forth. The torch 36 also may be a cutting torch, such as a plasma cutting torch. The generator 28 and/or circuit 58 also may provide a variety of output voltages and currents suitable for different applications. For example, a 12 volt DC output of the module 22 may also serve to maintain the vehicle battery charge, and to power any ancillary loads that the operator may need during work (e.g., cab lights, hydraulic system controls, etc.).

Figure 3:
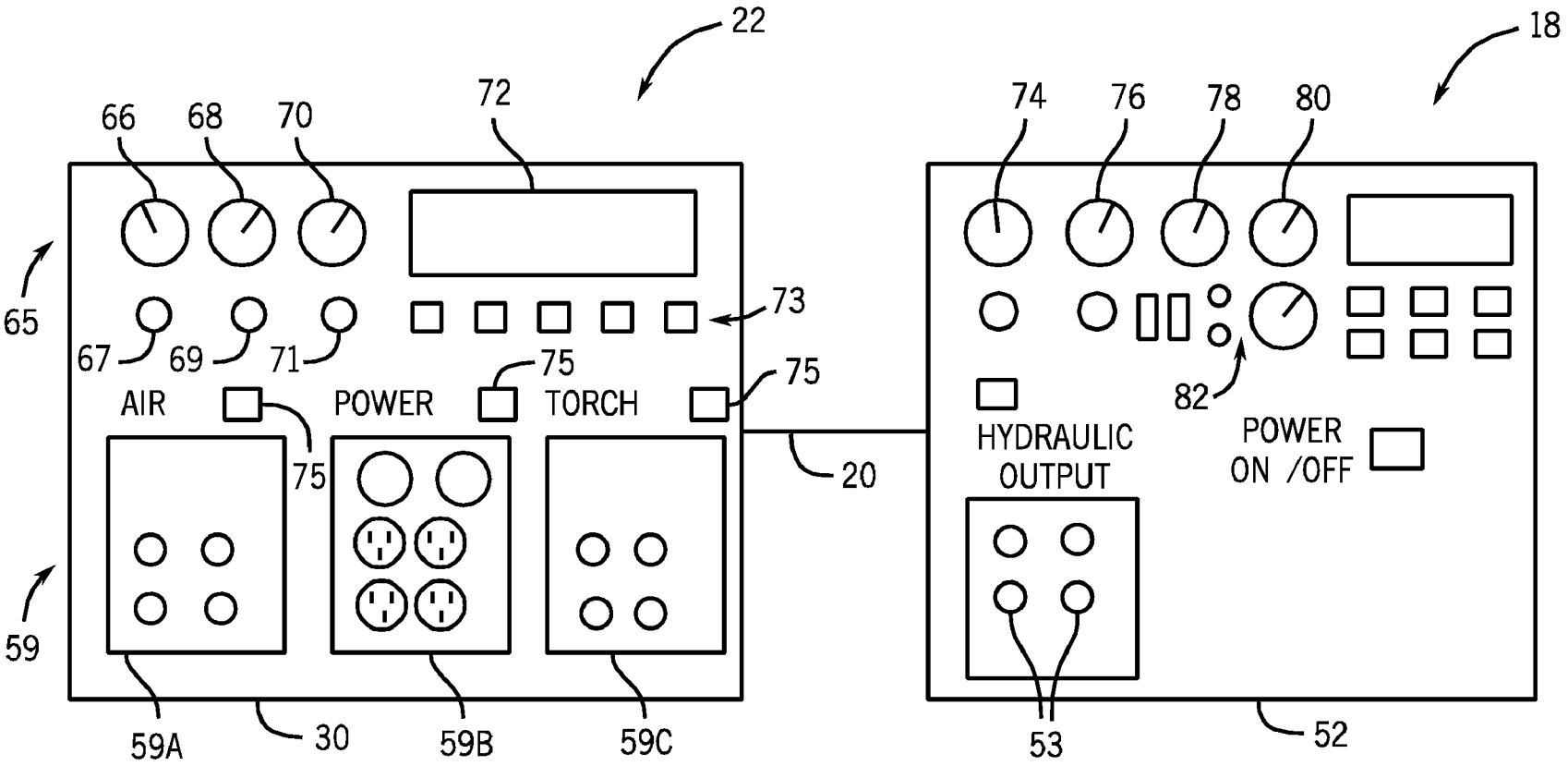
FIG. 3 is a diagram illustrating first and second control panels of the respective first and service pack modules as illustrated in FIG. 2, in accordance with embodiments of the present technique.

FIG. 3 illustrates an embodiment of the access panels 30 and 52 of the respective first and second service pack modules 18 and 22, as shown in FIGS. 1 and 2. In the illustrated embodiment, the access panel 30 of the module 22 includes the various couplings 59 and controls 65 shown in FIG. 2. Specifically, the couplings include a set of air couplings 59A, a set of electrical power couplings 59B, and a set of torch couplings 59C. The controls 65 include a voltage gauge 66 and associated voltage control knob 67, a current gauge 68 and associated current control knob 69, an air pressure gauge 70 and associated pressure control knob 71, and a display screen 72 (e.g., liquid crystal display) and associated input keys 73. The controls 65 also may include on/off switches or buttons 75 for each of the couplings 59, such that an operator can turn on and off the electrical power, the compressed air, and/or the fluid power (e.g., hydraulic power) linked to the couplings 59A, 59B, and 59C. Optionally, the access panel 30 may include various fluid couplings (e.g., hydraulic couplings), gauges, and controls in an embodiment that routes at least some of the fluid from the first module 18 through the second module 22 to various external hydraulic devices. Furthermore, the access panel 30 may be used as a central control panel for all resources/services provided by both modules 18 and 22 when these modules 18 and 22 are used in combination with one another.

In the illustrated embodiment, the access panel 52 may include several fluid (e.g., hydraulic) output couplings 53 as well as hydraulic and power controls to monitor and configure settings for service pack engine 14 and variable displacement pump 16. The access panel 52 may also permit, for example, starting and stopping of the service pack engine 14 by a keyed ignition or starter button. The access panel 52 may also include a stop, disconnect, or disable switch that allows the operator to prevent starting of the service pack engine 14, such as during transport. The access panel 52 may also include fluid (e.g., hydraulic) pressure gauge 74, engine RPM gauge 76, engine fuel gauge 78, engine temperature gauge 80, and various inputs and outputs as generally depicted by numeral 82.

Figure 4:
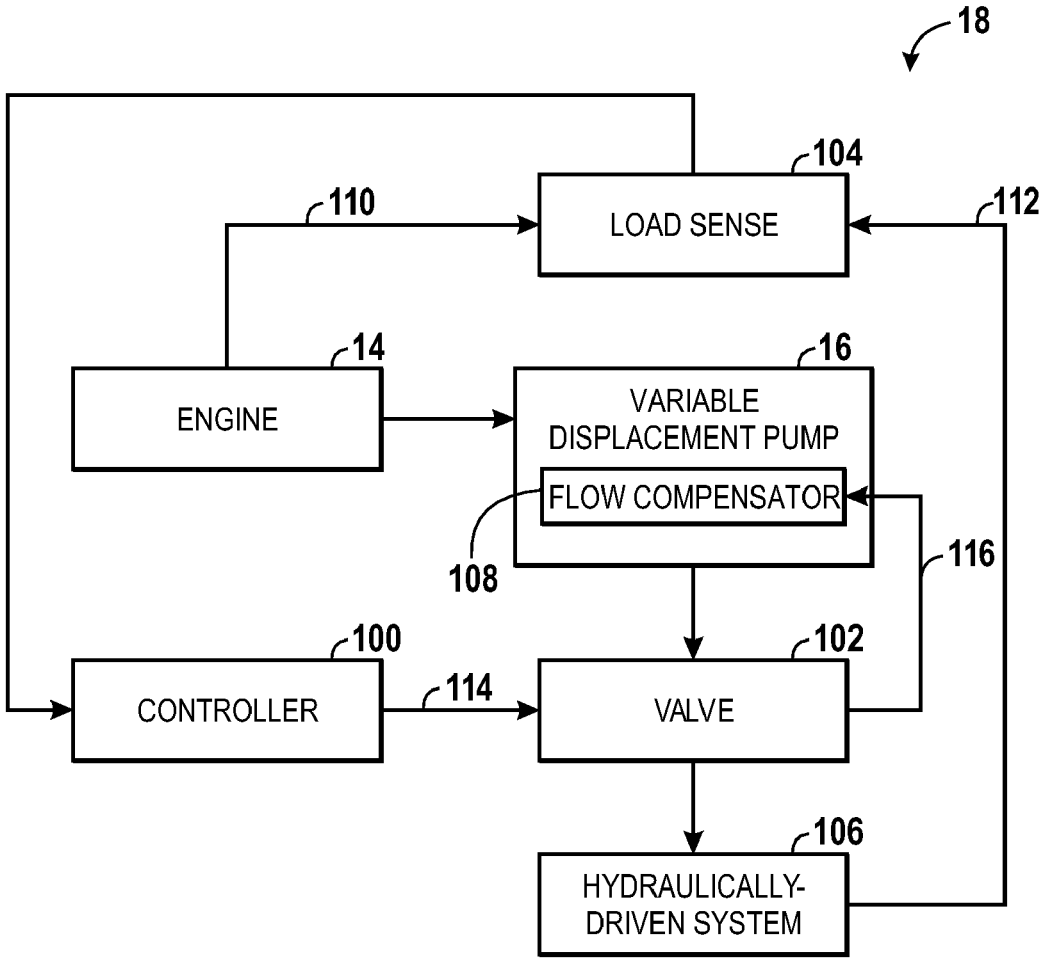
FIG. 4 is a diagram illustrating a system for controlling power of an engine driving a variable displacement pump with load sense in accordance with certain embodiments.

FIG. 4 is a diagram illustrating a system for controlling power of the service pack engine 14 driving the variable displacement pump 16 in accordance with certain embodiments. In certain embodiments, the pump 16 may be described as a variable displacement flow compensating piston pump 16. In the illustrated embodiment, the system includes the engine 14, the variable displacement pump 16, a controller 100, a valve 102, a load sense 104, a fluid (e.g., hydraulically) driven system 106, and a flow compensator 108 associated with the pump 16.

The illustrated controller 100 is configured to sense (via load sense 104) various load conditions 110 on the service pack engine 14, e.g., throttle/actuator position, fuel flow, engine torque, power output, RPM, exhaust temperature, and so forth. For example, in one specific embodiment, the load sense 104 monitors the throttle or actuator position on a carburetor or fuel injection system, thereby tracking the amount of fuel injected into the engine 14. The amount of fuel injection may be directly correlated to the engine load. For example, greater fuel injection may correlate with greater engine load, whereas lesser fuel injection may correlate with lesser engine load. The illustrated controller 100 is also configured to sense (via load sense 104) various load conditions 112 on the hydraulically driven system, e.g., hydraulic pressure, hydraulic flow rate, torque, power, and so forth.

As indicated by arrow 114, the controller 100 is configured to control the valve 102 in response to the load conditions 110 and/or 112 received from the load sense 104. If the controller 100 identifies a possible overload condition, then the controller 100 is configured to control the valve 102 to reduce the hydraulic-based load on the system and, thus, eliminate the possible overload condition. However, the controller 100 also may monitor under load conditions (e.g., wasted power), and reduce speed of the service pack engine 14, increase the hydraulic-based load on the system, and so forth.

The illustrated variable displacement pump 16 is configured to respond to the hydraulic pressure in the system via the flow compensator 108 (e.g., internal pump load sense). For example, the flow compensator 108 may receive feedback 116 relating to the pressure drop across the valve 102. Specifically, the flow compensator 108 may control or adjust the variable displacement pump 16 to increase pump displacement in response to a low hydraulic load (e.g., a low pressure drop) in the system. Similarly, the flow compensator 108 may control or adjust the variable displacement pump 16 to decrease pump displacement in response to a high hydraulic load (e.g., a high pressure drop) in the system. Again, the hydraulic load may correspond to a low or high pressure drop across the valve 102, which triggers the flow compensator 108 to adjust the displacement of the pump 16. In certain embodiments, the variable displacement pump 16 may include a piston, a shaft, and a variable displacement mechanism (e.g., a swash plate) disposed between the piston and the shaft. For example, the swash plate may be described as a disk attached to the shaft, wherein the disk has an adjustable angle relative to the shaft (e.g., between 0 and 90 degrees). The swash plate will provide maximum piston displacement at an angle less than 90 degrees between the swash plate and shaft, and will provide minimum piston displacement at an angle of 90 degrees between the swash plate and shaft. Thus, in certain embodiments, the flow compensator 108 may adjust the angle of the swash plate and, thus the displacement of the piston, to vary the output of the pump 16 in response to the sensed pressure drop across the valve 102. Furthermore, as discussed below, the disclosed embodiments enable control of the valve 102 in response to load conditions 110 and/or 112 from the load sense 104. As a result, the control scheme enables control of the variable displacement pump 16, such that the service pack engine 14 is not overloaded beyond its limits. As discussed above, this is particularly important due to the output limits of small engines 14.

In the illustrated embodiment, the controller 100 controls the valve 102 to induce a change in the hydraulic load (e.g., pressure drop) associated with the variable displacement pump 16. Specifically, the valve 102 may be a variable orifice valve operated by a drive, such as a solenoid. Thus, the valve 102 can provide a variable opening or path for the hydraulic fluid to pass on to the system 106. As a result, the valve 102 may increase the hydraulic pressure in the system by partially closing the valve 102, or the valve 102 may decrease the hydraulic pressure in the system by partially or fully opening the valve 102. As a result of the change in pressure drop across the valve 102, the variable displacement pump 16 may flow compensate via the flow compensator 108 and variable displacement mechanism (e.g., swash plate).

Figure 5:
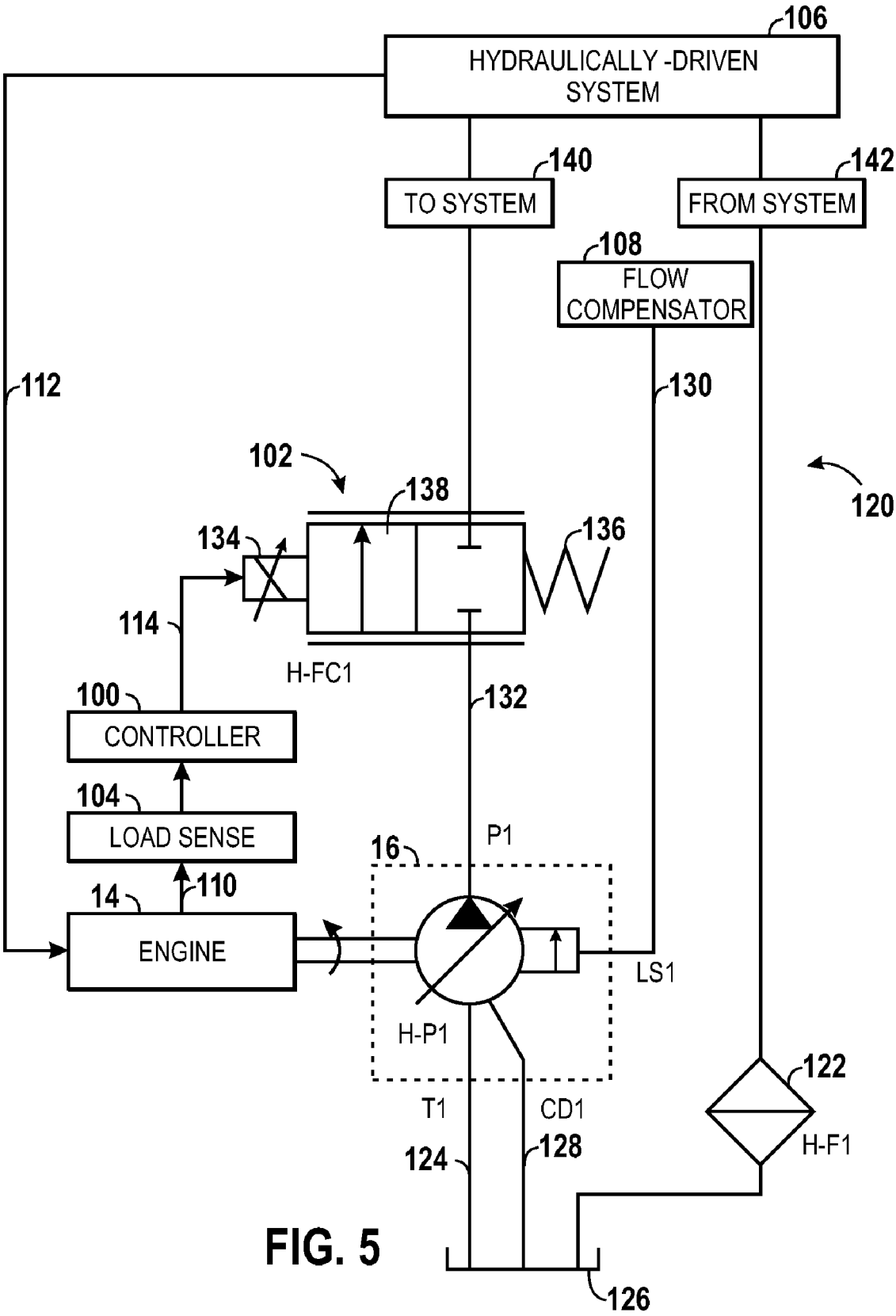
FIG. 5 is a diagram illustrating a variable displacement flow compensating pump with load sense in accordance with certain embodiments.

FIG. 5 is a diagram illustrating a variable displacement piston pump circuit 120 with flow compensator 108 in accordance with certain embodiments. As illustrated in FIG. 5, the circuit 120 includes a hydraulic pump 16 (H-P1) being driven by a prime mover 14 (e.g., an internal combustion engine), a hydraulic flow control valve 102 (H-FC1), and a hydraulic filter 122 (H-F1). The hydraulic pump 16 has a suction line 124 (T1) that receives fluid from a reservoir or tank 126, a case drain line 128 (CD1) that returns fluid to the reservoir 126, a flow compensation line 130 (LS1) coupled to the flow compensator 108, and a pressure line 132 (P1).

In the illustrated embodiment, the hydraulic pump 16 is a variable displacement pump with flow compensator 108. The pump 16 uses the flow compensation line 130 to maintain a constant, preset, pressure drop across valve 102. Regardless of load, the pump 16 maintains this preset pressure drop, provided the flow compensation line 130 is placed between the pressure drop control and the load. Greater flowrate creates greater pressure drop across components, and vise-verse, lesser flowrate creates less pressure drop across components. The hydraulic pump 16 with flow compensator 108 adjusts flow rate until the preset pressure drop is achieved.

The hydraulic flow control valve 102 may be a proportional valve that adjust variably from fully closed to fully open and all positions in between. This valve 102 is used to change the restriction in the pressure line 132, which in turn, adjusts the flowrate of the pump 16. As illustrated, the valve 102 includes a solenoid 134, a spring 136, and a valve member 138. The spring 136 biases the valve member 138 toward a normally closed position, whereas the solenoid 134 may be actuated to bias the valve member 138 toward a partially open or full open position. Thus, in response to the controller 100, the valve 102 may be partially opened or closed to control the pressure drop, which in turn controls the variable displacement of the pump 16. In turn, the change in the displacement of the pump 16 adjusts the load on the engine 14.

In general, end users typically have two different types of systems: closed-center and open-center. For a closed-center system, the center (or neutral) position is closed resulting in no flow. For an open-center system, the center (or neutral) position is open and the fluid is allowed to circulate back to the reservoir 126. The disclosed embodiments are designed to work with both systems with only minor modifications.

For a closed-center system, fluid is drawn from the reservoir 126 by the pump 16. Most of the fluid drawn to the pump 16 is delivered to the pressure line 132 (P1). Minimal fluid is delivered to the case drain line 128 (CD1), primarily for lubrication purposes. From pressure line 132 (P1) fluid flows through the flow control valve 102 (H-FC1) to the end users system 106. The fluid then typically passes through a closed-center directional control valve in the end users system 106 (block 140). After the directional control valve, the flow compensation line 130 is tapped into the system. After the location of the flow compensation line 130, the fluid then travels to a load (e.g., a hydraulic cylinder or motor). After the load, the fluid returns from the system 106 (block 142) to the reservoir 126 through the hydraulic filter 122 (H-F1).

The operator is able to control the flowrate from the hydraulic pump 16 to the system 106 by controlling the pressure drop across the closed-center directional control valve. As the operator closes the directional control valve, pressure drop increases, which in turn, reduces hydraulic pump flow. Hydraulic flow control valve 102 (H-FC1) is used to induce additional pressure drop as needed to prevent the prime mover 14 from being overloaded. In other words, the flow compensation line 130 is measuring the total pressure drop across the hydraulic flow control valve 102 (H-FC1) plus the directional control valve of the end users system 106.

For an open-center system, fluid is drawn from the reservoir 126 by the pump 16 to the pump 16. Most of the fluid drawn to the pump 16 is delivered to the pressure line 132 (P1). Minimal fluid is delivered to the case drain line 128 (CD1), primarily for lubrication purposes. From the pressure line 132 (P1), fluid flows through the flow control valve 102 (H-FC1). After the valve 102 (H-FC1), the flow compensation line 130 is tapped into the system. After the location of the flow compensation line 130, the fluid then typically passes through a by-pass flow control valve. This valve controls the amount of flow to the system, while the remaining flow is dumped back to the reservoir 126. From the by-pass flow control valve, fluid then goes to open-center directional control valves in the end user's system 106. After the open-center directional control valve, the fluid then travels to a load (e.g., a hydraulic cylinder or motor). After the load, the fluid returns to the reservoir 126 through the hydraulic filter 122 (H-F1).

The operator is able to control the flowrate from the hydraulic pump 16 by controlling the by-pass flow control valve. As the operator opens the by-pass flow control valve, additional flow is directed to the system, while the remaining flow is dumped to the reservoir 126. Hydraulic flow control valve 102 (H-FC1) is used to induce pressure drop which is read by the flow compensation line 130, which in turn, controls the flowrate of the pump 16 to prevent the prime mover 14 from being overloaded.

In both the closed-center and open-center systems, flow is controlled by inducing pressure drop across the valve 102 (H-FC1) until the power consumption of the system is matched by the engine 14 within a given set of parameters.

The disclosed embodiments may provide several advantages. For example, the disclosed embodiments allow the use of smaller prime mover (e.g., an IC engine) or the addition of other power consuming functions by controlling hydraulic power consumption. With a smaller engine, fuel efficiency and therefore fuel savings are inherent. The disclosed embodiments also may provide flexibility of the hydraulic circuit to be used for both closed-center and open-center systems. The disclosed embodiments also may provide power consumption control that overrides user demands when used with power feedback and control scheme.

Several alternatives are also contemplated. One alternative includes hydraulic flow control (H-FC1) in other locations. For example, it could be placed between the end user's closed-center valve and the load instead of before the end user's closed-center valve. Another alternative includes a plurality of fixed orifices used with directional control to add or subtract orifices, instead of a proportional valve for H-FC1. Another alternative includes a manual valve used with some type of manual or automated adjustment, instead of an electronic valve for H-FC1. Another alternative includes elimination of H-FC1 and use of a manual or automated actuation of the pump displacement to match the power consumption with the prime mover.

While only certain features of the invention have been illustrated and described herein, many modifications and changes will occur to those skilled in the art. It is, therefore, to be understood that the appended claims are intended to cover all such modifications and changes as fall within the true spirit of the invention.

The invention claimed is:

1. A service pack, comprising:

an engine;

a variable displacement pump coupled to the engine, wherein the variable displacement pump comprises a flow compensator;

an output fluid line coupled to the variable displacement pump;

a valve disposed in the output fluid line;

a load sense configured to monitor a load condition of the engine; and a controller configured to receive a first feedback indicative of the load condition from the load sense to control the valve, the valve is configured to control a pressure along the output fluid line, and the flow compensator is configured to control displacement of the variable displacement pump in response to a second feedback associated with the valve.

2. The service pack of claim 1, wherein the load sense is configured to monitor the load condition directly from the engine.

3. The service pack of claim 1, wherein the load sense is configured to monitor an engine operating parameter as the load condition, and the engine operating parameter comprises engine power, engine torque, engine RPM, engine throttle position, or engine exhaust temperature, or a combination thereof.

4. The service pack of claim 1, wherein the valve comprises a variable orifice valve.

5. The service pack of claim 1, wherein the valve comprises a solenoid configured to drive a valve member between opened and closed positions in response to the first feedback.

6. The service pack of claim 5, wherein the valve comprises a spring configured to bias the valve member in an opposite direction relative to the solenoid.

7. The service pack of claim 1, wherein the variable displacement pump is configured to reduce pump displacement in response to an increase in hydraulic load, and the variable displacement pump is configured to increase the pump displacement in response to a decrease in the hydraulic load.

8. The service pack of claim 7, wherein the hydraulic load comprises a pressure drop across the valve.

9. The service pack of claim 1, wherein the controller is configured to prevent a possible overload condition of the engine by varying the valve to adjust a pressure drop that is sensed by the flow compensator, and the flow compensator is configured to control a flowrate of the variable displacement pump.

10. The service pack of claim 1, wherein the variable displacement pump comprises a shaft, a swash plate coupled to the shaft, and a piston coupled to the swash plate, wherein the swash plate is configured to control displacement of the piston as the shaft rotates.

11. The service pack of claim 1, wherein the engine comprises a spark ignition engine or a compression ignition engine.

12. The service pack of claim 1, wherein the load sense is configured to monitor an engine parameter and a hydraulic load as the load condition.

13. A service pack, comprising:

an engine;

a variable displacement pump coupled to the engine;

at least one load sense configured to monitor an engine parameter and a hydraulic load as a load condition; and a controller configured to control displacement of the variable displacement pump in response to the load condition.

14. The service pack of claim 13, comprising:

an output fluid line coupled to the variable displacement pump, wherein the variable displacement pump comprises a flow compensator;

a valve disposed in the output fluid line; and wherein the controller is configured to receive a first feedback indicative of the load condition from the at least one load sense to control the valve, the valve is configured to control a pressure along the output fluid line, and the flow compensator is configured to control displacement of the variable displacement pump in response to a second feedback associated with the valve.

15. The service pack of claim 13, wherein the at least one load sense is configured to monitor the engine parameter directly from the engine.

16. The service pack of claim 13, wherein the at least one load sense is configured to monitor engine power, engine torque, engine RPM, engine throttle position, or engine exhaust temperature, or a combination thereof, as the engine parameter.

17. A service pack, comprising:

an engine;

a variable displacement pump coupled to the engine;

at least one load sense configured to monitor an engine parameter directly from the engine as a load condition; and a controller configured to control displacement of the variable displacement pump in response to the load condition.

18. The service pack of claim 17, comprising:

an output fluid line coupled to the variable displacement pump, wherein the variable displacement pump comprises a flow compensator;

a valve disposed in the output fluid line; and wherein the controller is configured to receive a first feedback indicative of the load condition from the at least one load sense to control the valve, the valve is configured to control a pressure along the output fluid line, and the flow compensator is configured to control displacement of the variable displacement pump in response to a second feedback associated with the valve.

19. The service pack of claim 17, wherein the at least one load sense is configured to monitor engine power, engine torque, engine RPM, engine throttle position, or engine exhaust temperature, or a combination thereof, as the engine parameter.

20. The service pack of claim 17, wherein the at least one load sense is configured to monitor engine throttle position, fuel flow, or a combination thereof, as the engine parameter.

* * * * *